US009382764B2

(12) United States Patent
Phan et al.

(10) Patent No.: US 9,382,764 B2
(45) Date of Patent: Jul. 5, 2016

(54) CONTRACTION JOINT SYSTEM

(71) Applicant: Schlumberger Technology Corporation, Sugar Land, TX (US)

(72) Inventors: Henry Phan, Houston, TX (US); John Algeroy, Houston, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 484 days.

(21) Appl. No.: 13/723,032

(22) Filed: Dec. 20, 2012

(65) Prior Publication Data

US 2013/0199799 A1 Aug. 8, 2013

Related U.S. Application Data

(60) Provisional application No. 61/596,278, filed on Feb. 8, 2012.

(51) Int. Cl.
*E21B 17/04* (2006.01)
*E21B 17/07* (2006.01)

(52) U.S. Cl.
CPC ..... *E21B 17/04* (2013.01); *E21B 17/07* (2013.01)

(58) Field of Classification Search
CPC ..... E21B 43/106; E21B 43/108; E21B 17/02; E21B 17/08
See application file for complete search history.

(56) References Cited

U.S. PATENT DOCUMENTS

| | | | | |
|---|---|---|---|---|
| 3,430,699 | A * | 3/1969 | De Cuir | E21B 23/02 166/217 |
| 8,061,430 | B2 * | 11/2011 | Du et al. | 166/380 |
| 2006/0260818 | A1 * | 11/2006 | Meijer et al. | 166/380 |
| 2008/0029274 | A1 * | 2/2008 | Rytlewski et al. | 166/375 |
| 2008/0110615 | A1 * | 5/2008 | Xu | 166/153 |
| 2010/0224375 | A1 * | 9/2010 | Du et al. | 166/380 |

* cited by examiner

*Primary Examiner* — William P Neuder
(74) *Attorney, Agent, or Firm* — David J. Groesbeck

(57) ABSTRACT

A system and methodology facilitates conveyance of a tool, e.g. a downhole completion or completion component, via a tool string. The tool string comprises a contraction joint designed to contract if the tool incurs sufficient axial loading. The contraction joint may comprise an outer housing and a mandrel slidably received in the outer housing. The contraction joint also comprises a resettable locking member which selectively releases the mandrel with respect to the outer housing to contract the contraction joint when under sufficient axial loading.

14 Claims, 9 Drawing Sheets

CONTRACTION JOINT SYSTEM

CROSS-REFERENCE TO RELATED APPLICATION

The present document is based on and claims priority to U.S. Provisional Application Ser. No. 61/596,278, filed Feb. 8, 2012, incorporated herein by reference.

BACKGROUND

Hydrocarbon fluids such as oil and natural gas are obtained from a subterranean geologic formation, referred to as a reservoir, by drilling a well that penetrates the hydrocarbon-bearing formation. After a wellbore is drilled, various types of well completion components are installed in the well to control fluid production and to enhance the efficiency of producing the hydrocarbon fluids from the reservoir. Various tools and work strings are used to properly install and position the well completion components.

SUMMARY

In general, the present disclosure provides a system and method to facilitate conveyance of a tool, e.g. a downhole completion or completion component, via a tool string. The tool string comprises a contraction joint which may be used to facilitate alignment of devices downhole. In some applications, the contraction joint may be designed to contract if the tool incurs substantial axial loading by, for example, hitting an obstruction as it moves downhole along a wellbore. The contraction joint may comprise an outer housing and a mandrel slidably received in the outer housing. The contraction joint also comprises a resettable locking member which selectively releases the mandrel with respect to the outer housing to contract the contraction joint when placed under sufficient axial loading.

However, many modifications are possible without materially departing from the teachings of this disclosure. Accordingly, such modifications are intended to be included within the scope of this disclosure as defined in the claims.

BRIEF DESCRIPTION OF THE DRAWINGS

Certain embodiments of the disclosure will hereafter be described with reference to the accompanying drawings, wherein like reference numerals denote like elements. It should be understood, however, that the accompanying figures illustrate the various implementations described herein and are not meant to limit the scope of various technologies described herein, and.

DETAILED DESCRIPTION

Figure 1:
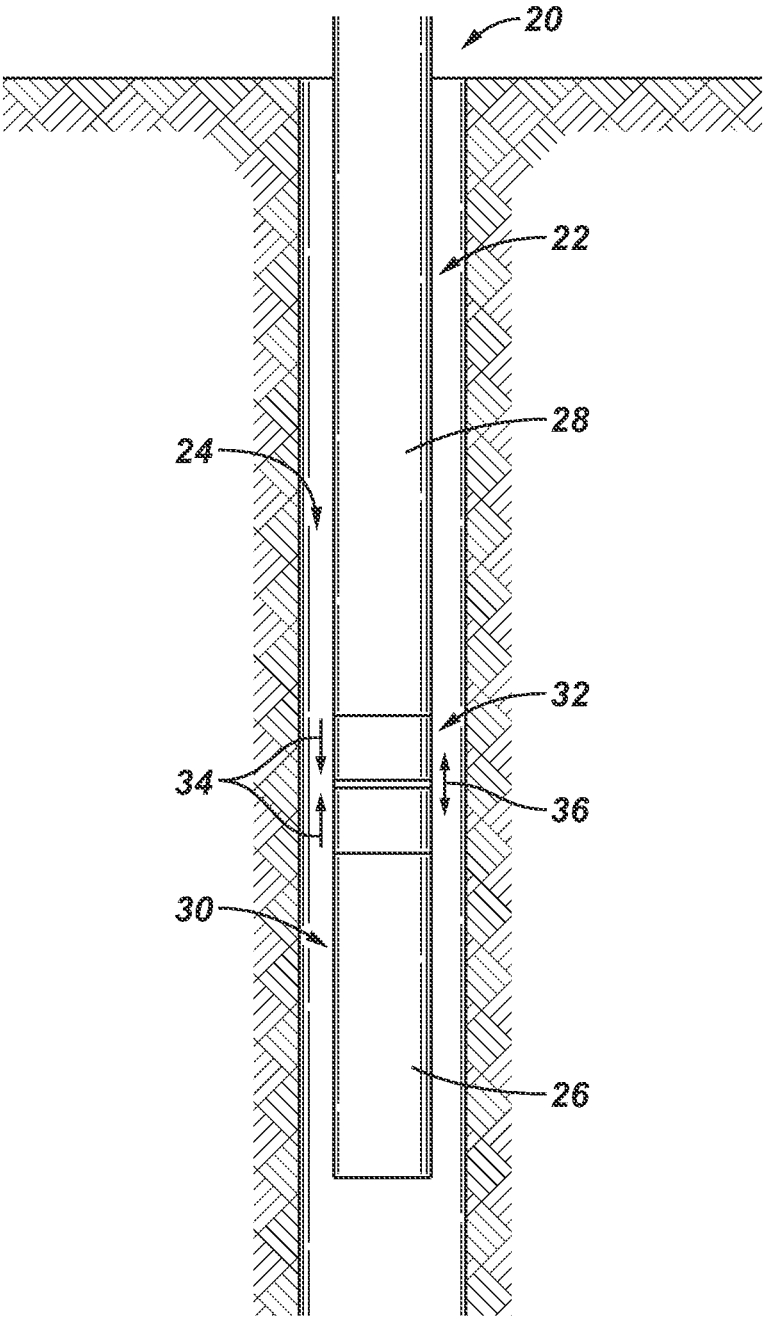
FIG. 1 is an illustration of a well system comprising a tool string having an embodiment of a contraction joint deployed in a wellbore, according to an embodiment of the disclosure.

In the following description, numerous details are set forth to provide an understanding of some embodiments of the present disclosure. However, it will be understood by those of ordinary skill in the art that the system and/or methodology may be practiced without these details and that numerous variations or modifications from the described embodiments may be possible.

The present disclosure generally involves a system and methodology to facilitate conveyance of a tool in an environment in which the tool may meet obstructions or other elements that cause relatively high axial loading. For example, the system and methodology may be utilized with well strings, such as tool strings used to deploy completions and/or other equipment downhole in a wellbore. In such an application, the tool string comprises a contraction joint designed to contract if the tool incurs substantial axial loading as it moves downhole along a wellbore. If, for example, the completion or other tool is run in hole and encounters an obstruction in the wellbore, the contraction joint is designed to contract under the resulting axial loads which often are substantially higher than the normal axial loading incurred while running in hole. The contraction joint also may be used in aligning devices downhole. For example, a well string may be latched at a first position to properly place a desired tool, and then the contraction joint may be contracted to precisely place another tool at a different location along the wellbore.

The contraction joint may comprise a variety of configurations. By way of example, the contraction joint may comprise an outer housing and a mandrel slidably received in the outer housing. In this example, the contraction joint also has a resettable locking member which selectively releases the mandrel with respect to the outer housing to contract the contraction joint when under sufficient axial loading. Subsequently, the contraction joint may be reset to its normal, extended operational configuration by applying a pulling force to cause relative extension between the mandrel and the outer housing.

In embodiments utilizing the internal mandrel and the corresponding outer housing, relative axial movement is resisted by the resettable locking member until sufficient force is applied in an axial direction to cause release of the resettable locking member and contraction of the overall contraction joint. The contraction joint may be repeatedly relocked/reset following contraction without pulling the tool out of the hole to reset the contraction joint at the surface. By way of example, the contraction joint may be reset by pulling on the tool string to cause relative shifting of the mandrel and outer housing until the contraction joint is extended and reset in its normal operating position. After resetting the contraction joint, the running in hole of the tool string may be continued without pulling the system back to the surface.

In some embodiments, the resettable locking member comprises a collet which interacts with a contraction joint mandrel and housing. In other embodiments, the resettable locking member comprises a shiftable bearing member, e.g. a bearing ball or a plurality of bearing balls, positioned to transfer axial thrust loads between the mandrel and the outer housing. In this latter example, a spring member, such as a split ring (e.g. a C-ring) may be used to releasably hold the bearing balls in place. When a sufficient axial force is applied, the spring member is flexed so as to release the balls and to thus allow the mandrel to slide relative to the outer housing and contract the contraction joint. Conversely, pulling apart the mandrel and the outer housing moves the bearing balls until they snap back into their recess positions and lock the contraction joint in the original, extended position.

Referring generally to FIG. 1, an embodiment of a system, e.g. a well string system, is illustrated as comprising a contraction joint. By way of example, the well string system may comprise many types of completions, completion components, and other downhole equipment and components. The well string may be employed in many types of applications and environments, including cased wells and open-hole wells. The well string also may be run into horizontal wells and other deviated wells. The system may employ various constructions of the contraction joint between, for example, a conveyance and a tool, e.g. well completion. However, the contraction joint may be used in combination with other types of tool strings in both well and non-well related applications.

In the example of FIG. 1, a system 20 is illustrated as a tool string, e.g. a well string 22 deployed in a wellbore 24. Well string 22 comprises a tool 26 which is deployed downhole by a conveyance 28. The tool 26 may comprise a completion 30, a completion component, or other downhole equipment conveyed to a desired downhole location. The conveyance 28 may comprise a variety of suitable structures, such as coiled tubing, production tubing, or other types of conveyances. In the example illustrated, a contraction joint 32 is located between the tool 26 and the conveyance 28. In some applications, the contraction joint 32 is positioned to directly couple the tool 26 to the conveyance 28.

The contraction joint 32 is designed to contract in a longitudinal direction in the event an axially directed force of a sufficient magnitude acts on the contraction joint 32, as indicated by arrows 34. By way of example, the axially directed contraction force 34 may be caused intentionally to align or actuate devices, or the force may be caused by engagement of the tool 26 with an obstruction in wellbore 24 during conveyance of the tool 26 to a predetermined wellbore location. Once the obstruction is removed or the situation is otherwise resolved, the contraction joint 32 is designed to allow resetting/relocking of the joint at its original, longitudinally extended position.

As indicated by arrow 36, an expansion force, e.g. an axially directed separation force, may be applied to contraction joint 32 to longitudinally extend or expand the contraction joint. In some applications, a lifting force may be applied to conveyance 28 until the contraction joint 32 is sufficiently extended to snap back into (or otherwise reset at) its original, extended position. When in the extended position, the contraction joint 32 is designed to handle the normal axial loads incurred during deployment of tool 26. However, if another obstruction or other occurrence causes elevated axial loading 34 beyond a given threshold, the contraction joint 32 is designed to again contract. The contraction joint 32 is designed to enable repeated cycles of contraction followed by resetting/relocking of the contraction joint 32 in the extended position used during normal deployment operations.

Figure 2:
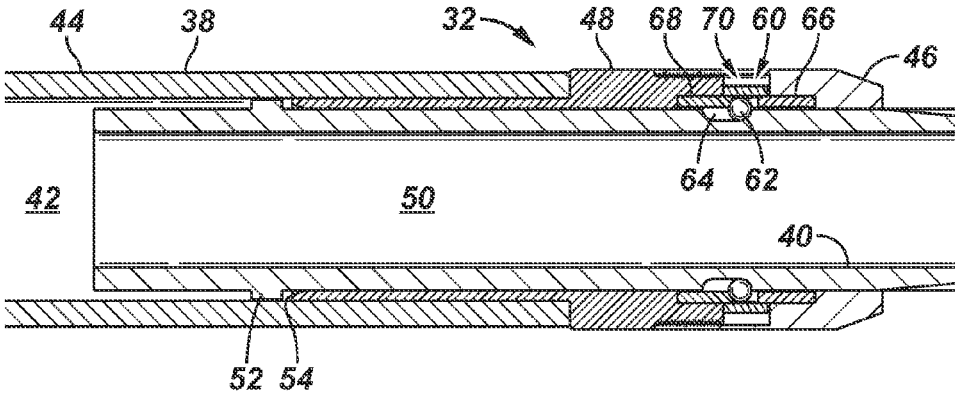
FIG. 2 is a cross-sectional view of an example of the contraction joint illustrated in FIG. 1, according to an embodiment of the disclosure.

Referring generally to FIG. 2, an embodiment of contraction joint 32 is illustrated. In this embodiment, contraction joint 32 comprises an outer housing 38 and a mandrel 40, e.g. a sleeve, slidably received in an open interior 42 of the outer housing 38. By way of example, outer housing 38 may be constructed of various components, such as a tubular housing portion 44 coupled with an end cap 46 by an intermediate housing portion 48. In the example illustrated, mandrel 40 is generally tabular and comprises a hollow interior 50. The mandrel 40 also may comprise a stop 52 designed and positioned to cooperate with a corresponding stop 54 of intermediate housing portion 48. The stop 52 and corresponding stop 54 limit the axial extension of contraction joint 32 and also may be used to absorb or resist tensile loading acting on the contraction joint 32.

Figure 3:
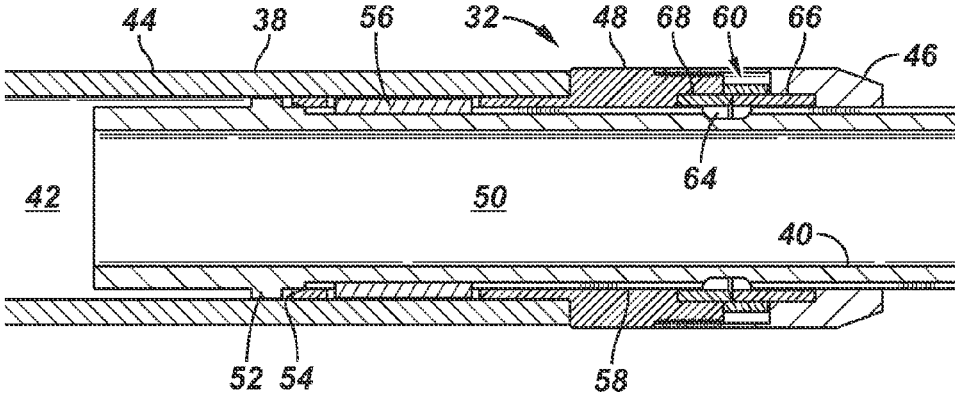
FIG. 3 is a cross-sectional view similar to that of FIG. 2 but taken along another plane through the contraction joint, according to an embodiment of the disclosure.

In some applications, outer housing 38 may be in the form of a spline sub having splines 56, as best illustrated in FIG. 3. The splines 56 may be designed to extend inwardly from intermediate housing portion 48 and into corresponding spline grooves 58 formed along the external surface of mandrel 40. The splines 56 allow relative axial movement between the mandrel 40 and the outer housing 38 while preventing relative rotational movement between mandrel 40 and outer housing 38.

The contraction joint 32 further comprises a resettable locking member 60 which is designed to selectively release the mandrel 40 with respect to the outer housing 38 in a manner which enables contraction of the contraction joint 32 under sufficient axial loading. The resettable locking member 60 also is designed to reset/relock the mandrel 40 with respect to the outer housing 38 in an original extended position following the contraction. For example, after contraction of contraction joint 32, sufficient expansion of the contraction joint 32 to the position illustrated in FIG. 2 causes resetting/relocking of the contraction joint 32 in its normal operational position to enable continued running in hole of tool 26.

Figure 4:
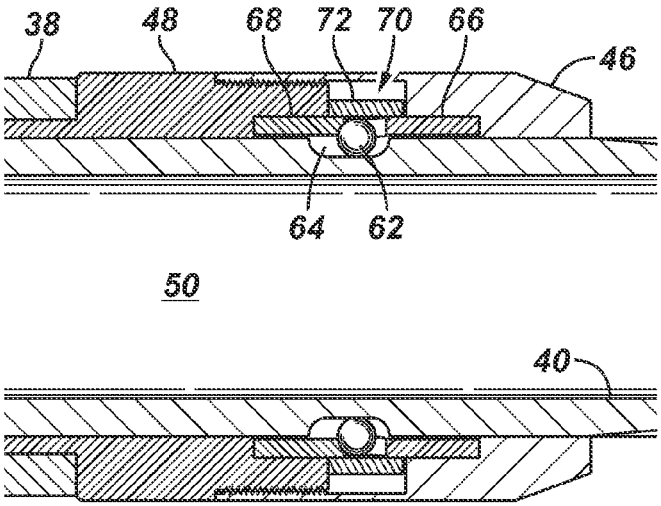
FIG. 4 is an enlarged cross-sectional view of a portion of an embodiment of the contraction joint, according to an embodiment of the disclosure.
Figure 5:
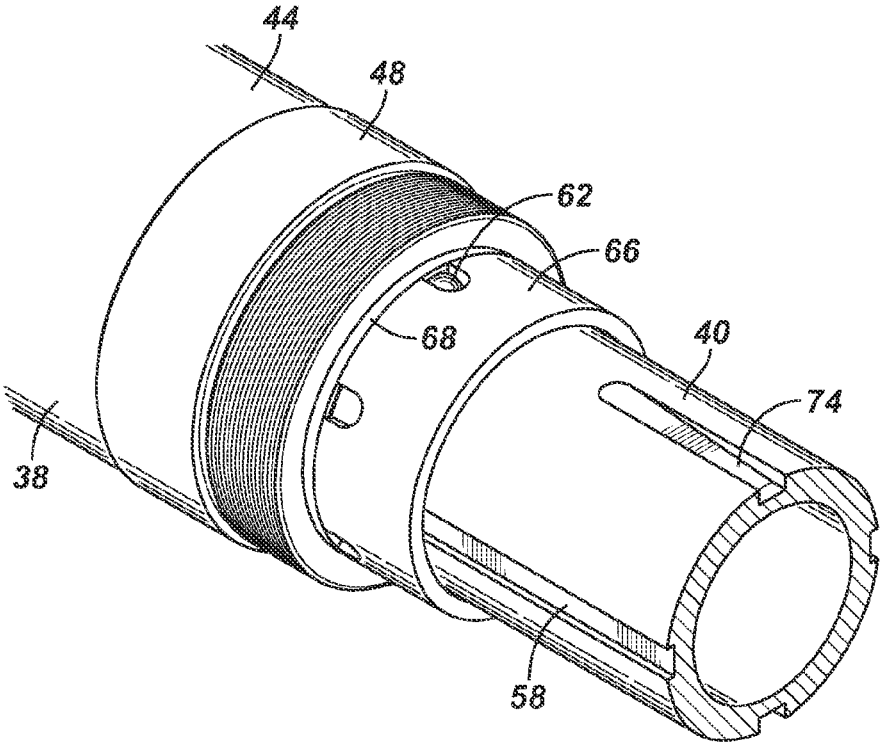
FIG. 5 is an orthogonal view of a portion of an embodiment of the contraction joint having an end cap removed, according to an embodiment of the disclosure.

With added reference to FIGS. 4 and 5, an example of resettable locking member 60 is illustrated. In this example, the resettable locking member 60 comprises a retention member 62 which may be in the form of a bearing ball acting between mandrel 40 and outer housing 38. In the specific example illustrated, a plurality of bearing balls 62 is positioned between mandrel 40 and outer housing 38. By way of example, the balls 62 may be positioned in a recess or recesses 64 of mandrel 40 when the contraction joint 32 is in its normal operational, extended position. The recess 64 may be located along an exterior of mandrel 40. The ball 62 also may extend into engagement with the outer housing 38 via a bearing cage 66 and a cooperating bearing race 68. A spring member 70 is used to bias the balls 62 toward retained engagement with recess 64. (It should be noted that other embodiments may reverse or alter the arrangement of components, including forming the recess in the outer housing 38 and utilizing the bearing cage 66/bearing race 68 or other suitable retention mechanisms along the mandrel 40.)

Figure 6:
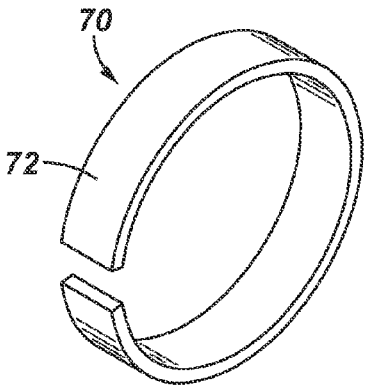
FIG. 6 is an orthogonal view of an embodiment of a spring member employed in the contraction joint illustrated in FIG. 4, according to an embodiment of the disclosure.
Figure 7:
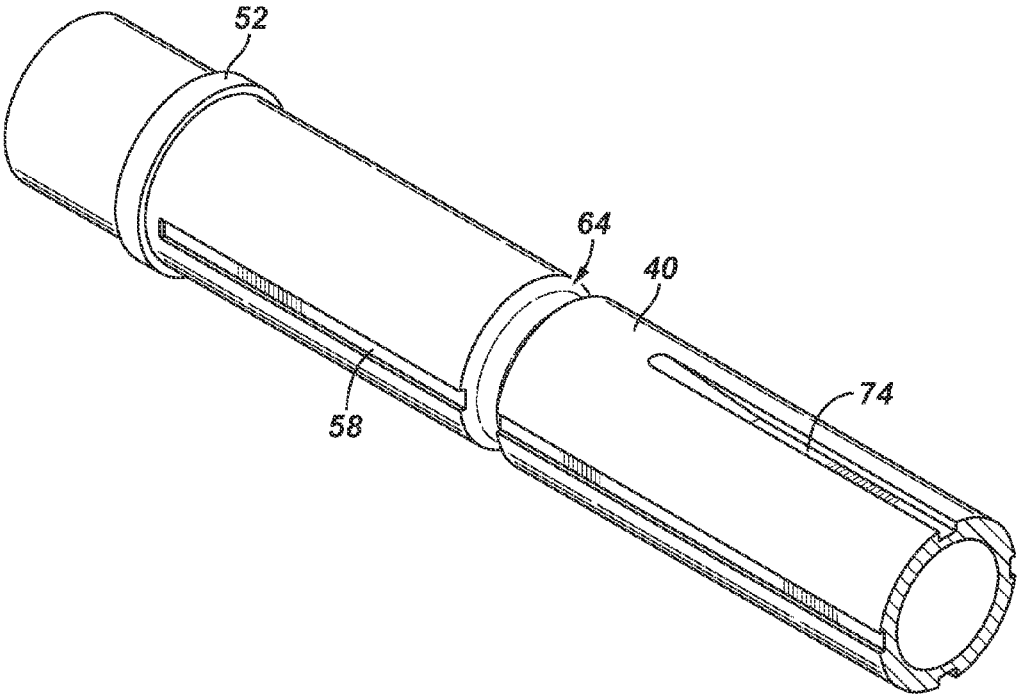
FIG. 7 is an orthogonal view of an example of a mandrel employed in the contraction joint illustrated in FIG. 4, according to an embodiment of the disclosure.

In the embodiment illustrated in FIG. 6, the spring member 70 is formed as a split ring 72, e.g. a C-ring. By way of example, the split ring 72 may be used in cooperation with bearing cage 66 and bearing race 68 to secure the balls 62 in a common recess 64, as best illustrated in FIG. 7 which shows an example of mandrel 40. In this example, mandrel 40 also comprises a plurality of longitudinal ball slots 74 along which the balls 62 move during contraction or expansion of contraction joint 32. In some embodiments, however, the mandrel 40 may be designed without the longitudinal ball slots 74.

Figure 8:
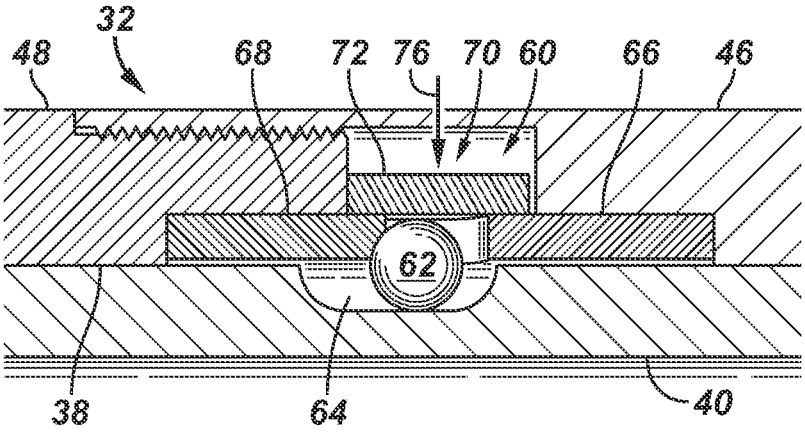
FIG. 8 is a partial cross-sectional view of an embodiment of the resettable locking member prior to selective release of a mandrel with respect to an outer housing to enable contraction of the contraction joint, according to an embodiment of the disclosure.

As best illustrated in FIG. 8, the split ring 72 may be positioned to encircle the balls 62 in a manner which applies a radially inward force against the balls 62, as represented by arrow 76. This inwardly directed force 76 retains balls 62 within recess 64 until a sufficient axial force is able to overcome the bias of spring member 70 so as to flex the spring member 70 until balls 62 are released from recess 64. Effectively, balls 62 are trapped between recess 64 of mandrel 40 and bearing cage 66/bearing race 68 of outer housing 38 to lock the mandrel 40 against relative axial movement with respect to outer housing 30 during normal operations, e.g. during normal running in hole of tool 26.

Figure 9:
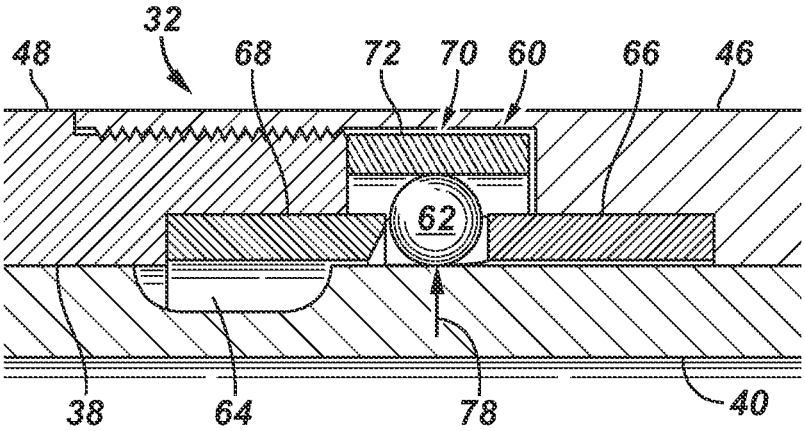
FIG. 9 is a partial cross-sectional view indicating selective release of a mandrel with respect to an outer housing to enable contraction of the contraction joint, according to an embodiment of the disclosure.

If tool 26 engages an obstruction or if another event occurs which causes axial loading of the contraction joint 32 beyond a predetermined threshold, the resettable locking member 60 is designed to release and to allow contraction of contraction joint 32. In the embodiment illustrated, the recess 64 is designed to release balls 62 upon the sufficient axial loading. As illustrated best in FIG. 9, the design of recess 64 exerts an outward bias against the balls 62 under axial loading, as represented by arrow 78. Under the sufficient axial loading, the outwardly directed force 78 overcomes the biasing force of spring member 70, e.g. split ring 72, and flexes the spring member outwardly to release the balls 62, as illustrated in FIG. 9.

Figure 10:
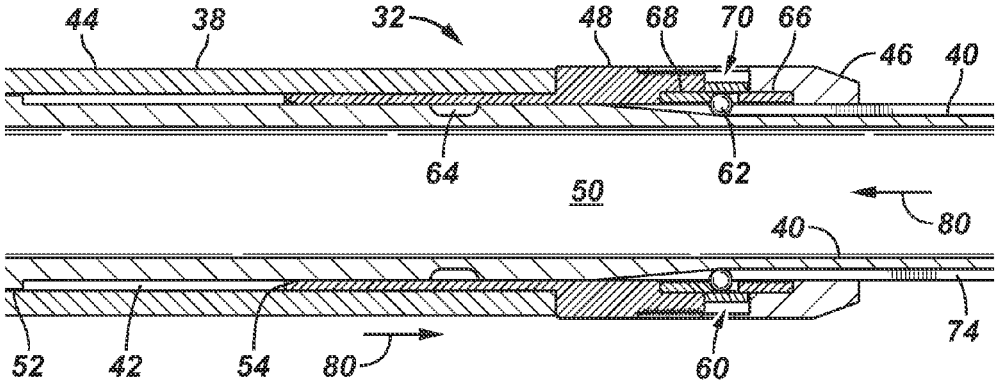
FIG. 10 is a cross-sectional view of an embodiment of the contraction joint with arrows showing the relative movement of components during contraction, according to an embodiment of the disclosure.

Once the balls 62 are released, the mandrel 40 is able to slide within outer housing 38, as indicated by arrows 80 in FIG. 10. The mandrel 40 moves into outer housing 38 to contract the overall length of contraction joint 32, thus avoiding deleterious effects of the impact with an obstruction or of another type of event creating increasing axial loading beyond the level sufficient to force balls 62 out of recess 64. If the mandrel 40 is designed with longitudinal ball slots 74, the balls 62 may role along the slots 74 during contraction, as further illustrated in FIG. 10.

Figure 11:
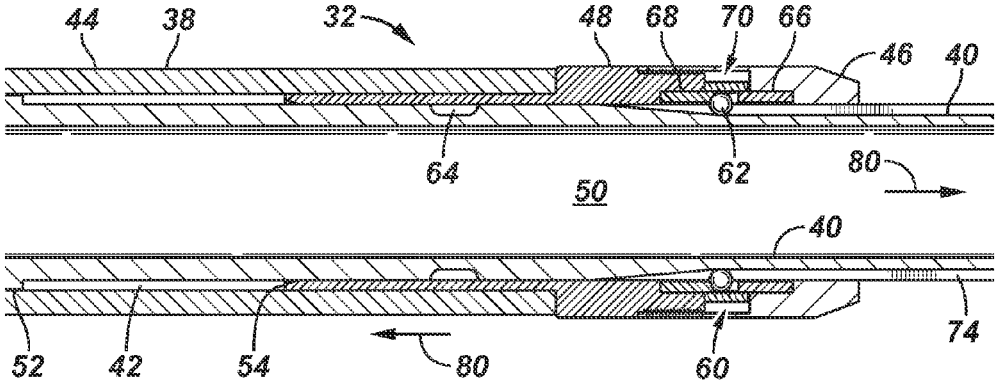
FIG. 11 is a cross-sectional view of an embodiment of the contraction joint with arrows showing the relative movement of components during expansion and resetting of the contraction joint, according to an embodiment of the disclosure.
Figure 12:
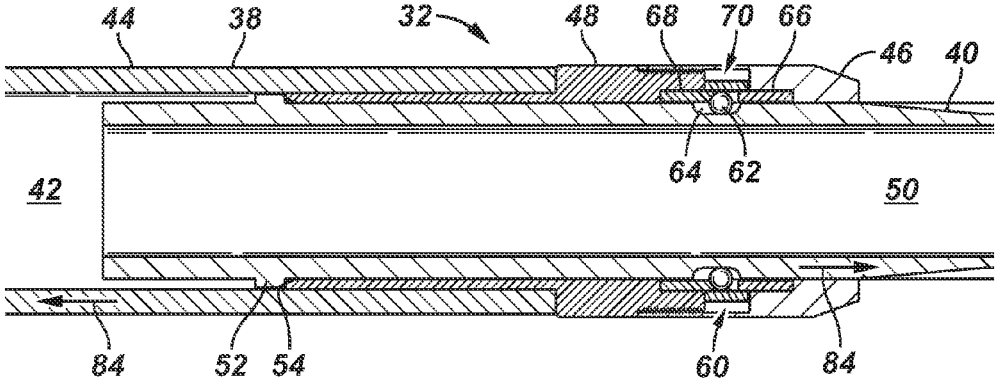
FIG. 12 is an illustration similar to that of FIG. 10 but showing the contraction joint reset at its original position, according to an embodiment of the disclosure.

After addressing the issue, e.g. obstruction, which caused the increased axial loading, the contraction joint 32 may be reset and relocked in its normal, extended operational position. Similarly, the contraction joint may be reset after using the joint to align devices, e.g. inductive coupler devices, at downhole locations, as described in greater detail below. To reset, an axially directed expansion force is applied between the mandrel 40 and the outer housing 38, as indicated by arrows 82 in FIG. 11. By way of example, the expansion force 82 may be applied by lifting on the tool string 22 to cause relative movement of mandrel 40 and outer housing 38 until the contraction joint 32 is expanded back to its original, operational configuration, as best illustrated in FIG. 12. Effectively, the expansion continues until balls 62 are biased back into recess 64 by spring member 70. In some applications, the stop 52 and corresponding stop 54 also are brought into engagement or near engagement to prevent further axial expansion of contraction joint 32 and to resist tensile loading indicated by arrows 84.

Figure 13:
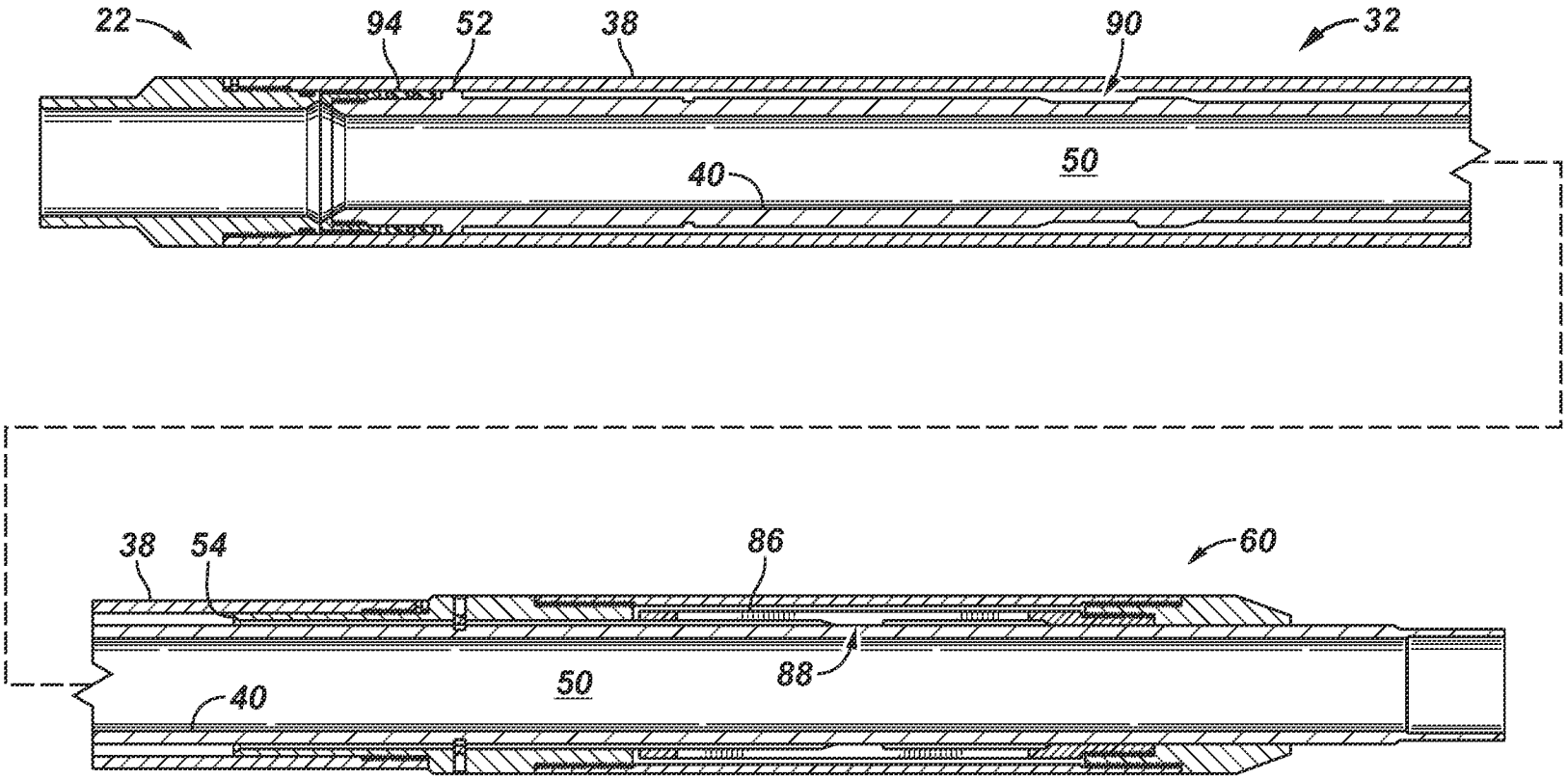
FIG. 13 is a cross-sectional view of another example of the contraction joint illustrated in FIG. 1, according to an embodiment of the disclosure.
Figure 14:
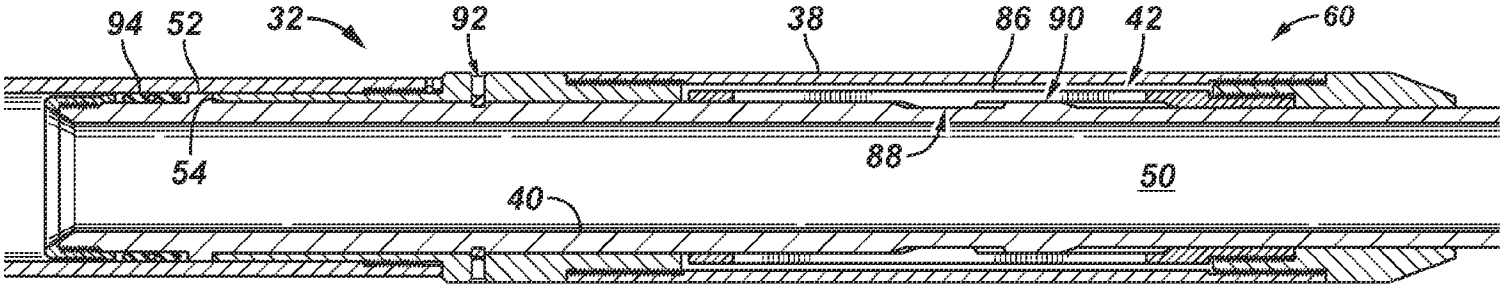
FIG. 14 is an enlarged cross-sectional view of a portion of the embodiment of the contraction joint illustrated in FIG. 13, according to an embodiment of the disclosure.

Referring generally to FIGS. 13 and 14, another embodiment of contraction joint 32 is illustrated. In this embodiment, contraction joint 32 also comprises outer housing 38 and mandrel 40, e.g. a sleeve, slidably received in open interior 42 of the outer housing 38. As with the previously described embodiment, outer housing 38 may be constructed of various housing components integrated or fastened together. In the example illustrated, mandrel 40 is generally tubular and comprises hollow interior 50. The mandrel 40 also may comprise the stop 52 designed and positioned to cooperate with the corresponding stop 54 of outer housing 38. The stop 52 and corresponding stop 54 limit the axial extension of contraction joint 32 and also may be used to absorb or resist tensile loading acting on the contraction joint 32.

Figure 15:
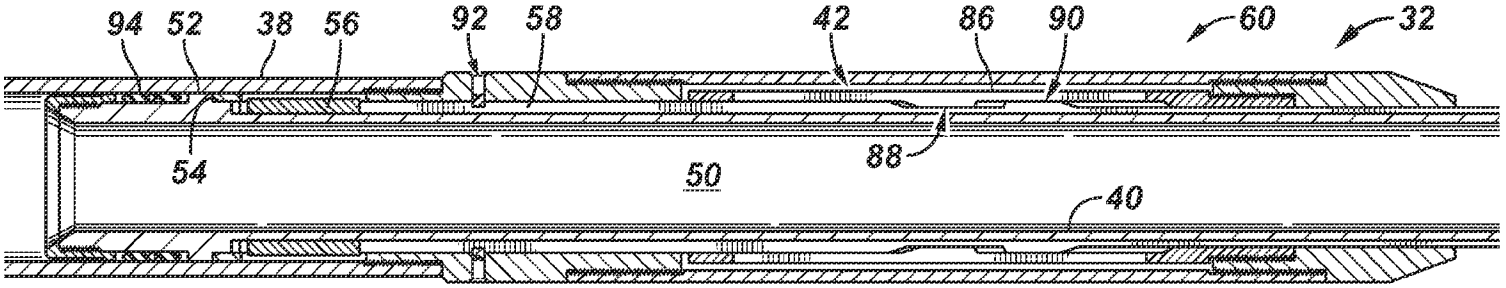
FIG. 15 is a cross-sectional view similar to that of FIG. 14 but taken along another plane through the contraction joint, according to an embodiment of the disclosure.

In some applications, outer housing 38 may comprise the spline sub having splines 56, as best illustrated in FIG. 15. The splines 56 may be designed to extend inwardly from housing 38 and into corresponding spline grooves 58 formed along the external surface of mandrel 40. The splines 56 allow relative axial movement between the mandrel 40 and the outer housing 38 while preventing relative rotational movement between mandrel 40 and outer housing 38.

This embodiment of contraction joint 32 further comprises resettable locking member 60 which is designed to selectively release the mandrel 40 with respect to the outer housing 38 in a manner which enables contraction of the contraction joint 32 under sufficient axial loading (see FIG. 13). The resettable locking member 60 is again designed to reset/relock the mandrel 40 with respect to the outer housing 38 in an original extended position following the contraction. For example, after contraction of contraction joint 32, sufficient expansion of the contraction joint 32 to the position illustrated in FIG. 14 causes resetting/relocking of the contraction joint 32 in its normal extended position.

As best illustrated in FIG. 14, this embodiment of resettable locking member 60 utilizes a collet 86 that interacts with mandrel 40 and outer housing 38. Collet 86 is designed with a plurality of engagement features 88 positioned to engage corresponding features 90 on mandrel 40 when the contraction joint 32 is in the normal extended position. In this example, the engagement features 88 and corresponding features 90 are designed to resist contraction of contraction joint 32 until compressive axial loading exceeds a predetermined threshold. However, following contraction, the contraction joint 32 may be reset to the position illustrated in FIG. 14 with a tensile force that may be substantially less than the compressive force causing contraction. When the collet 86 is designed to enable a relatively low tensile force to reset the collet, this facilitates ease of resetting the contraction joint 32. Engagement features 88 and corresponding features 90 may be designed in a variety of configurations to provide the desired threshold force for contraction according to the parameters of a given application.

In the illustrated embodiment, contraction joint 32 may comprise a variety of other features depending on the applications for which it is designed. For example, a shear member 92, such as a plurality of shear pins, may initially be deployed between outer housing 38 and mandrel 40 to resist the initial contraction of contraction joint 32. The shear member 92 may aid in running the well string downhole into a wellbore without inadvertently causing contraction of the contraction joint 32. Additionally, a seal 94, such as a seal stack, may be positioned between the outer housing 38 and mandrel 40 to maintain sealing engagement.

Figure 16:
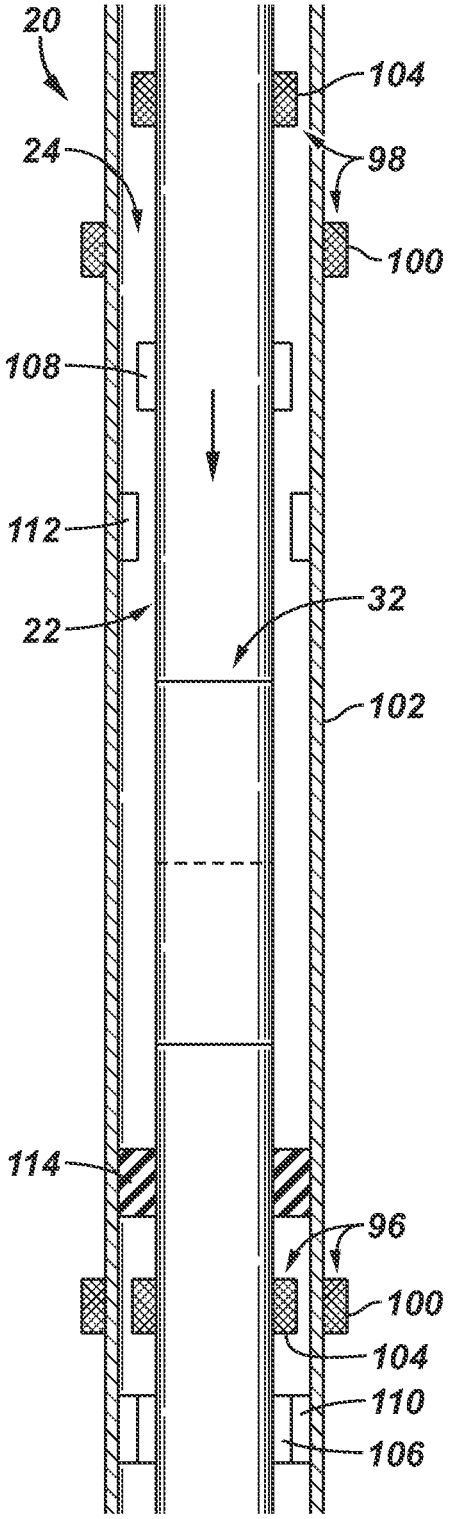
FIG. 16 is an illustration of a well system comprising a tool string having an embodiment of a contraction joint used to facilitate alignment of devices in a wellbore, according to an embodiment of the disclosure.

Referring generally to FIG. 16, an operational example is illustrated to facilitate explanation of how contraction joint 32 may be used in a well string 22. In this example, the well string 22 comprises a plurality of devices, e.g. a first device 96 and a second device 98 which are aligned downhole during a given well operation. By way of example, first device 96 and second device 98 may comprise inductive couplers each having an external coupler portion 100 mounted on a surrounding completion 102 which works in cooperation with an internal coupler portion 104 mounted on the well string 22. In many applications, the devices/inductive couplers 96 and 98 may be separated by substantial distance along the wellbore 24. Consequently, achieving sufficient alignment of the internal coupler portion 104 with the external coupler portion 100 for each of the separated devices 96, 98 can be difficult without being able to adjust the effective length of the well string 22. Contraction joint 32 may be used between devices 96 and 98 to provide the lineal adjustability which facilitates alignment of each device 96 and 98.

In an operational example, the well string 22 comprises a first latch mechanism 106 positioned downhole or below contraction joint 32. The well string 22 also comprises a second latch mechanism 108 positioned uphole or above contraction joint 32. It should be noted that downhole/below means a greater distance along the wellbore 24 than the contraction joint 32 and uphole/above means a lesser distance along the wellbore than the contraction joint 32. Thus, the relative orientation is clear regardless of whether the operation is performed in a vertical or deviated wellbore.

In this example, the well string 22 is run downhole into wellbore 24 until first latch mechanism 106 engages a lower latch 110 to provide proper alignment of first device 96. If first device 96 comprises an inductive coupler, for example, the internal coupler 104 of the first device is brought into proper alignment with the external coupler 100 to enable proper communication of signals therebetween. Once first latch mechanism 106 is latched, loading placed on well string 22 causes release and contraction of contraction joint 32. Continued contraction of joint 32 occurs until second latch mechanism 108 engages an upper latch 112 to provide proper alignment of second device 98. Again, if second device 98 comprises an inductive coupler, the internal coupler 104 of the second device is brought into proper alignment with the external coupler 100 to enable proper communication of signals therebetween.

However, instead of utilizing mechanical latches, the lower and upper mechanisms 110, 112 may be replaced by or may utilize a variety of other types of alignment techniques. For example, electrical, optical, mechanical, and various combinations of techniques may be employed to properly align first device 96 and second device 98. When first device 96 and second device 98 are the form of inductive couplers, for example, the inductive couplers 96, 98 may be used to provide feedback. In this type of technique, the inductive couplers 96 and/or 98 output a signal when the internal coupler 104 is aligned with the external coupler 100 of each inductive coupler. Based on the feedback signal, proper alignment of both devices may be confirmed upon sufficient contraction of contraction joint 32.

In other applications, additional electrical and/or optical sensors also may be employed to determine and verify proper alignment of devices 96, 98. In some examples, combinations of techniques may be employed to establish the desired alignment. For example, lower latch 110 may be employed to properly align device 96, and the upper inductive coupler 98 may be designed to output a feedback signal indicating proper alignment of the internal coupler 104 with the corresponding upper external coupler 100. Various other techniques, sensors, combinations of sensors and latches, and other suitable alignment techniques may be employed downhole to establish the proper alignment of first device 96 and/or second device 98 through the operation of contraction joint 32. Additionally, the inductive coupler signals and/or sensor signals may be transmitted uphole via several telemetry techniques, including electrical transmission, optical transmission, pulse transmission, acoustic transmission, combinations of techniques, and other suitable telemetry techniques.

In many applications, contraction joint 32 is relatively long to enable substantial lineal adjustment with respect to the position of the second device 98 in achieving the desired alignment. By way of example, the contraction joint may be designed to allow several feet of contraction, e.g. 15-25 feet of contraction. This facilitates alignment of devices 96, 98 within small tolerances even if the devices 96, 98 are separated by substantial distances, e.g. separated by 3000 feet or more. The contraction joint 32 readily allows for alignment of the second/upper device 98 after landing of the first device 96. In the inductive coupler embodiment, for example, the lower coupler/device 96 may be initially landed in completion 102 of a lateral wellbore, and contraction of contraction joint 32 enables subsequent alignment of the upper coupler/device 98 at the front of the lateral wellbore 24 (or even in the motherbore portion of wellbore) within precise tolerance limits.

Depending on the specifics of a given wellbore operation, well string 22 may comprise a variety of other or additional components, such as one or more packers 114 which may be used to create seals between work string 22 and the surrounding completion 102 at desired locations along the completion. Additionally, the portions of well string 22 below contraction joint 32 and above contraction joint 32 may be landed in a variety of devices. Latches 110, 112 also may comprise a variety of features, including locators, collets, and/or other features to facilitate landing of the well string 22.

Additionally, the contraction joint 32 may be used in many types of tool strings, including well strings and non-well related strings susceptible to deleterious axial loading. Depending on the parameters of a given application, the contraction joint 32 may comprise a variety of components and arrangements of components. For example, the retention member 62 may be in the form of an individual ball, a plurality of balls, or other types of suitable retention members. Other examples of retention members include cylinders, disks, pins, or other types of retention members that can be selectively moved upon sufficient axial loading. Similarly, spring member 70 may comprise a variety of individual springs associated with individual retention members or a variety of collective springs which act against a plurality of retention members, e.g. split-ring 72 acting against a plurality of airing balls.

Additionally, the overall structure of the contraction joint may have several configurations depending on the parameters of a given application. For example, various components may be reversed with respect to the mandrel and the outer housing.

The mandrel and/or the outer housing also may have a variety of forms, configurations, and lengths depending on the specific application. The materials used in forming the components may be adjusted according to environmental factors or other parameters. The axial loading sufficient to cause contraction of the contraction joint also can be adjusted to accommodate the various expected loads during a given operation.

Although a few embodiments of the disclosure have been described in detail above, those of ordinary skill in the art will readily appreciate that many modifications are possible without materially departing from the teachings of this disclosure. Accordingly, such modifications are intended to be included within the scope of this disclosure as defined in the claims.

What is claimed is:

1. A system for use in a well, comprising:

a conveyance;

a downhole tool; and a contraction joint disposed between the downhole tool and the conveyance, the contraction joint comprising:

an outer housing;

a mandrel slidably received in the outer housing; and a resettable locking member which selectively releases the mandrel with respect to the outer housing to contract the contraction joint under sufficient axial loading, the resettable locking member relocking the mandrel with respect to the housing upon sufficient expansion of the contraction joint, wherein the resettable locking member comprises a ball trapped in a recess formed in the mandrel to lock the mandrel and the outer housing in an expanded position, the ball being forced out of the recess when the contraction joint is under the sufficient axial loading, wherein the ball is held in the recess by a spring member.

2. The system as recited in claim 1, wherein the resettable locking member further comprises a collet.

3. The system as recited in claim 1, wherein the spring member comprises a split ring.

4. The system as recited in claim 1, wherein the contraction joint further comprises a stop positioned to limit expansion of the contraction joint and to resist tensile loading.

5. The system as recited in claim 1, wherein the outer housing comprises a spline sub.

6. A method, comprising:

providing a tool string with a contraction joint to enable longitudinal contraction upon application of axially directed loading on the tool string above a predetermined level;

locking the contraction joint at an expanded position with a resettable locking mandrel;

latching the tool string at a first location in a wellbore downhole from the contraction joint;

contracting the contraction joint by applying a load on the tool string; and during contraction of the contraction joint, subsequently latching the tool string at a second location uphole from the contraction joint upon sufficient contraction of the contraction joint, wherein locking the contraction joint comprises locking a mandrel with respect to an outer housing via a ball received in a recess; and holding the ball in the recess with a spring member until axially directed loading above the predetermined level causes sufficient flexing of the spring member to slidably release the mandrel and the outer housing for contraction of the contraction joint.

7. The method as recited in claim 6, further comprising utilizing the resettable locking member in the contraction joint to enable repeated resetting of the contraction joint at its expanded position after each longitudinal contraction.

8. The system as recited in claim 7, wherein the ball comprises a plurality of balls.

9. The system as recited in claim 8, wherein the plurality of balls is held in place along the outer housing by a bearing race.

10. The system as recited in claim 7, wherein the mandrel comprises a plurality of engagement features positioned to engage corresponding features on the collet.

11. The method as recited in claim 6, further comprising using the contraction joint to latch the tool string with a completion at the first location and the second location.

12. The method as recited in claim 6, wherein holding comprises holding a plurality of balls with at least one bearing race in combination with the spring member in the form of a split ring.

13. The method as recited in claim 6, wherein locking the contraction joint comprises locking a mandrel with respect to an outer housing with a collet.

14. The method as recited in claim 6, further comprising aligning inductive couplers at the first location and at the second location.

* * * * *